US012611043B1

(12) United States Patent
Wininger

(10) Patent No.: US 12,611,043 B1
(45) Date of Patent: Apr. 28, 2026

(54) BEDDING SECURING AND MAKING SYSTEM

(71) Applicant: Sean Wininger, Charleston, SC (US)

(72) Inventor: Sean Wininger, Charleston, SC (US)

( * ) Notice: Subject to any disclaimer, the term of this patent is extended or adjusted under 35 U.S.C. 154(b) by 283 days.

(21) Appl. No.: 18/498,143

(22) Filed: Oct. 31, 2023

(51) Int. Cl.
*A47C 21/02* (2006.01)
*A44B 11/00* (2006.01)

(52) U.S. Cl.
CPC ..... *A47C 21/022* (2013.01); *A47C 21/028* (2013.01); *A44B 11/005* (2013.01)

(58) Field of Classification Search
CPC ..... A47G 9/0261; A47G 2009/0269; A47C 21/022; A47C 21/028; A44B 11/005; A44B 11/006
USPC ..... 5/498
See application file for complete search history.

(56) References Cited

U.S. PATENT DOCUMENTS 1,695,592 A * 12/1928 Kromer ..... A41F 1/00 5/498
1,742,064 A * 12/1929 Dinstuhl ..... A47G 9/0238 5/498
2,024,050 A * 12/1935 May ..... A47C 21/022 24/72.5
3,011,182 A * 12/1961 Alice ..... A47C 31/105 5/484
3,092,848 A * 6/1963 Gronvold ..... A47C 21/022 24/72.5
3,134,110 A 5/1964 Gamichon
4,222,139 A * 9/1980 Svedberg-Reker ..... A47C 21/022 5/669
4,301,561 A * 11/1981 McLeod ..... A47G 9/02 5/923
4,572,174 A * 2/1986 Eilender ..... A61G 7/057 128/889
5,027,456 A * 7/1991 Wadsworth ..... A61F 5/3776 5/494
5,325,554 A * 7/1994 Lewis ..... A47C 21/022 5/692
6,233,764 B1 * 5/2001 Orr ..... A47G 9/0246 5/692
D481,579 S 11/2003 Colbert
6,834,405 B1 * 12/2004 Hillstead ..... A47D 15/008 5/655
9,254,046 B1 2/2016 Arenstein
10,932,585 B1 * 3/2021 Sopher ..... A47C 21/028
11,439,258 B2 9/2022 Grell
2003/0154549 A1 * 8/2003 Landry ..... A47D 15/02 5/923
2018/0303256 A1 * 10/2018 Sturgeon ..... A47C 21/022
2020/0260881 A1 * 8/2020 Deragon ..... A47C 21/022
2020/0260886 A1 8/2020 Chen
2021/0274943 A1 9/2021 Adjesson
(Continued)

FOREIGN PATENT DOCUMENTS

CA 2220539 6/1999

*Primary Examiner* — Myles A Throop

(57) ABSTRACT

The bedding securing and making system incorporates a bed structure, a plurality of rigid straps, and a plurality of fastening devices. The plurality of rigid straps and the plurality of fastening devices attach to the bedding structure. The bed structure further includes a mattress structure, a mattress frame structure, and a bedding. The mattress structure mounts on the mattress frame structure. The plurality of rigid straps and the plurality of fastening devices secure the bedding to the mattress structure.

7 Claims, 9 Drawing Sheets

(56) References Cited

U.S. PATENT DOCUMENTS

| | | | | |
|---|---|---|---|---|
| 2025/0031861 | A1* | 1/2025 | Troy | A47C 31/105 |
| 2025/0049236 | A1* | 2/2025 | Austion | A47G 9/0253 |

* cited by examiner

BEDDING SECURING AND MAKING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of bedding holders. (A47C21/022)

SUMMARY OF INVENTION

The bedding securing and making system comprises a bed structure, a plurality of rigid straps, and a plurality of fastening devices. The plurality of rigid straps and the plurality of fastening devices attach to the bedding structure. The bed structure further comprises a mattress structure, a mattress frame structure, and a bedding. The mattress structure mounts on the mattress frame structure. The plurality of rigid straps and the plurality of fastening devices secure the bedding to the mattress structure.

These together with additional objects, features and advantages of the bedding securing and making system will be readily apparent to those of ordinary skill in the art upon reading the following detailed description of the presently preferred, but nonetheless illustrative, embodiments when taken in conjunction with the accompanying drawings.

In this respect, before explaining the current embodiments of the bedding securing and making system in detail, it is to be understood that the bedding securing and making system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bedding securing and making system.

It is therefore important that the claims be regarded as including such equivalent construction insofar as they do not depart from the spirit and scope of the bedding securing and making system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
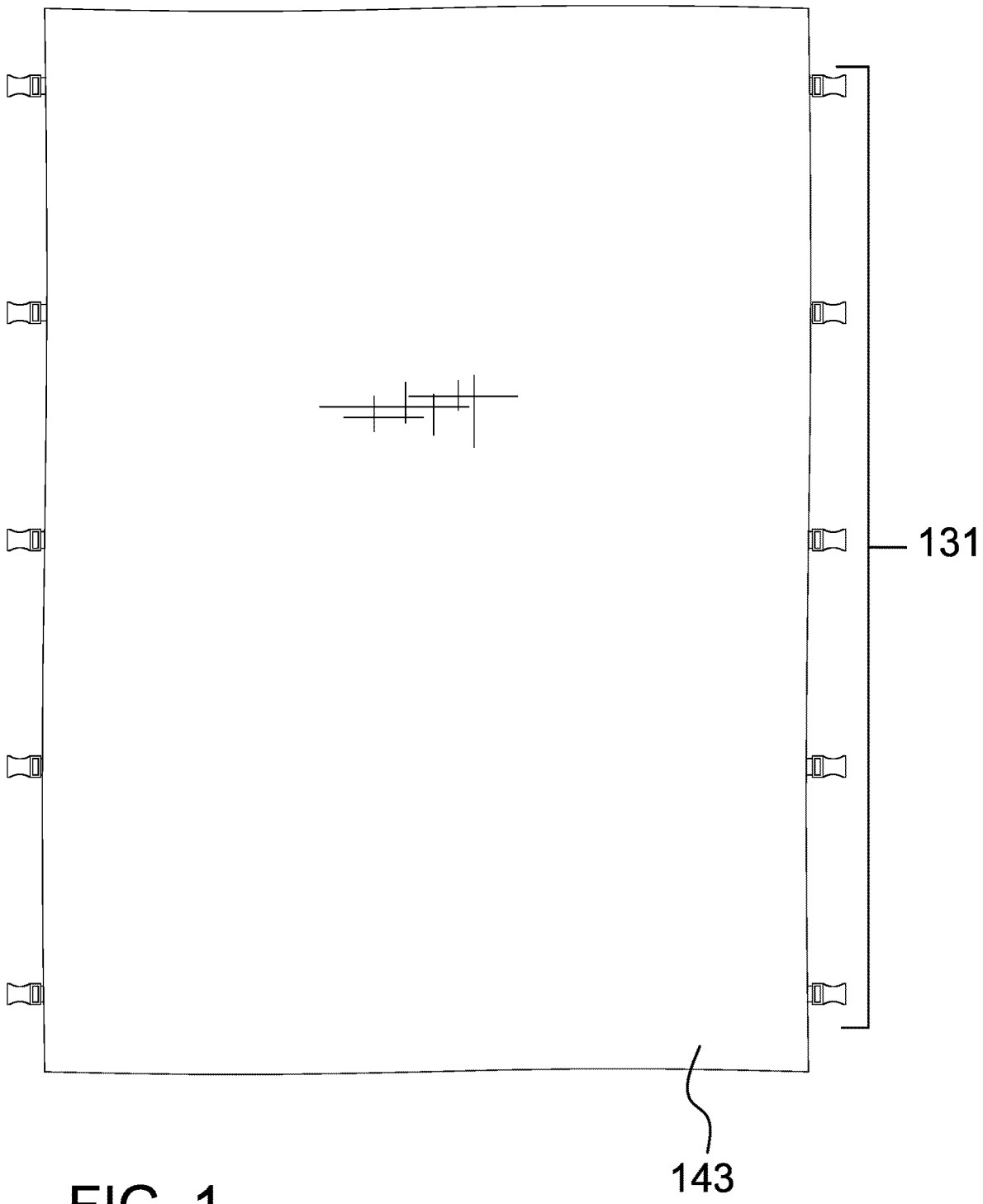
FIG. 1 is a superior view of an embodiment of the disclosure.
Figure 2:
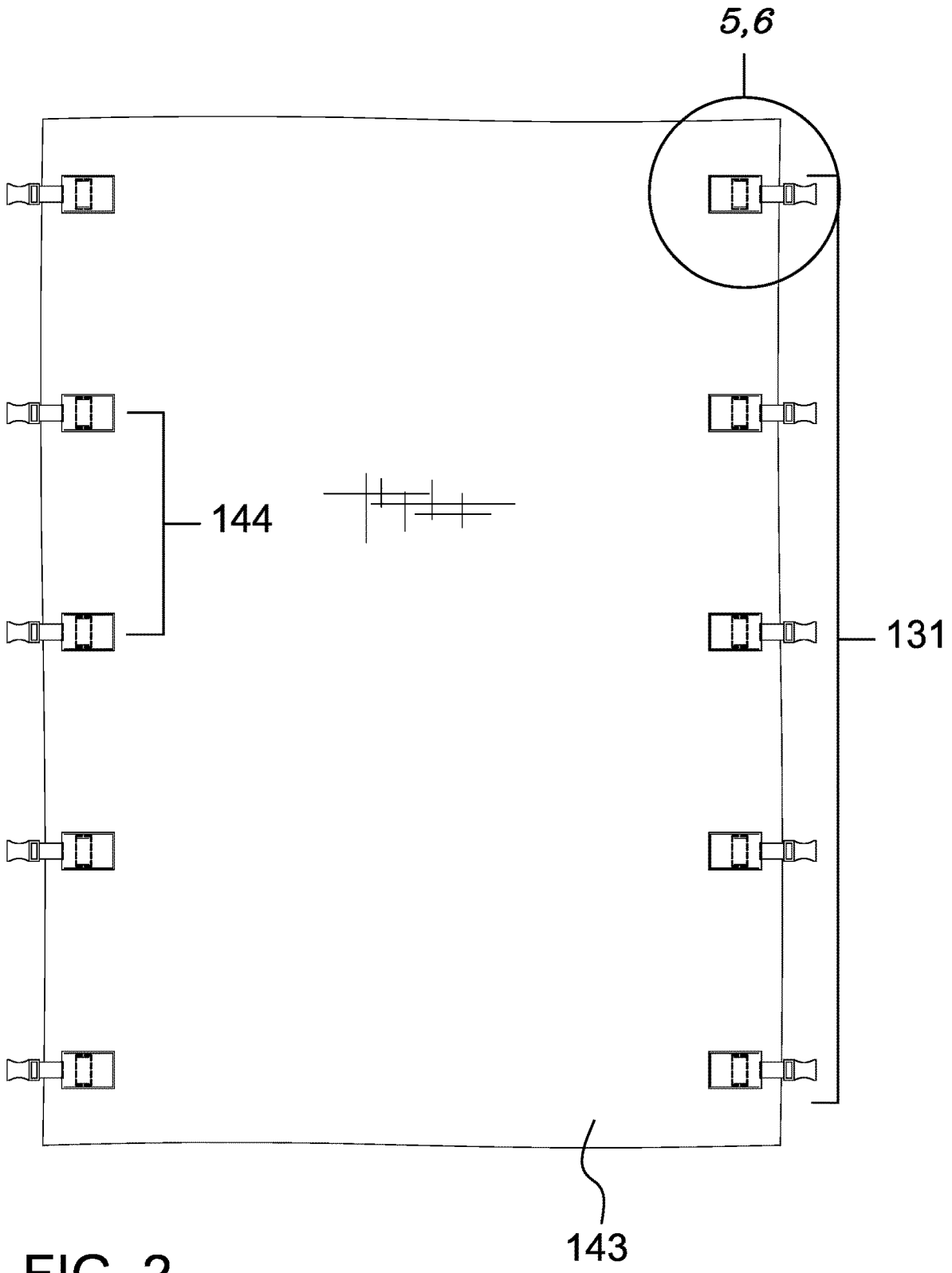
FIG. 2 is an inferior view of an embodiment of the disclosure.
Figure 3:
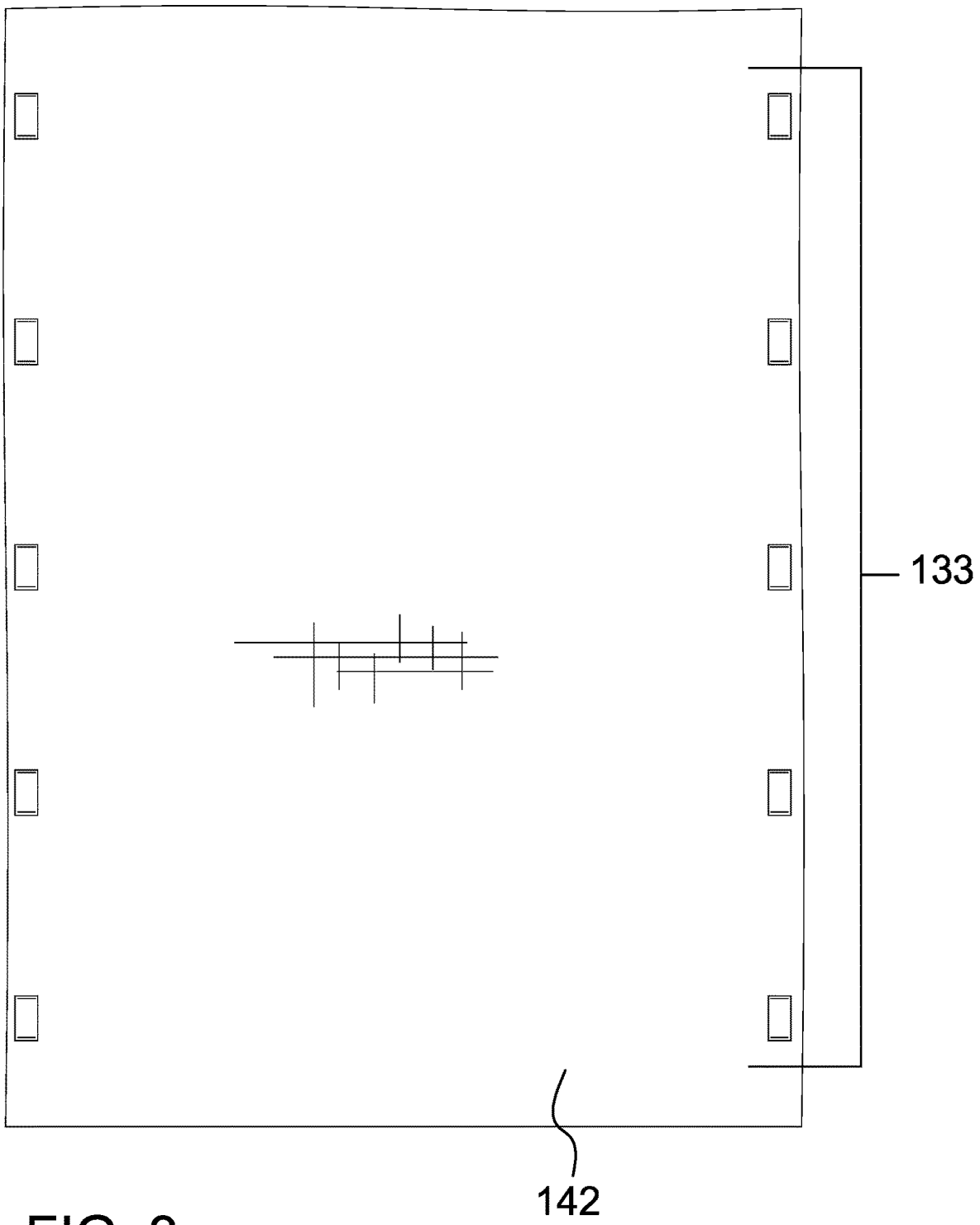
FIG. 3 is a superior view of an embodiment of the disclosure.
Figure 4:
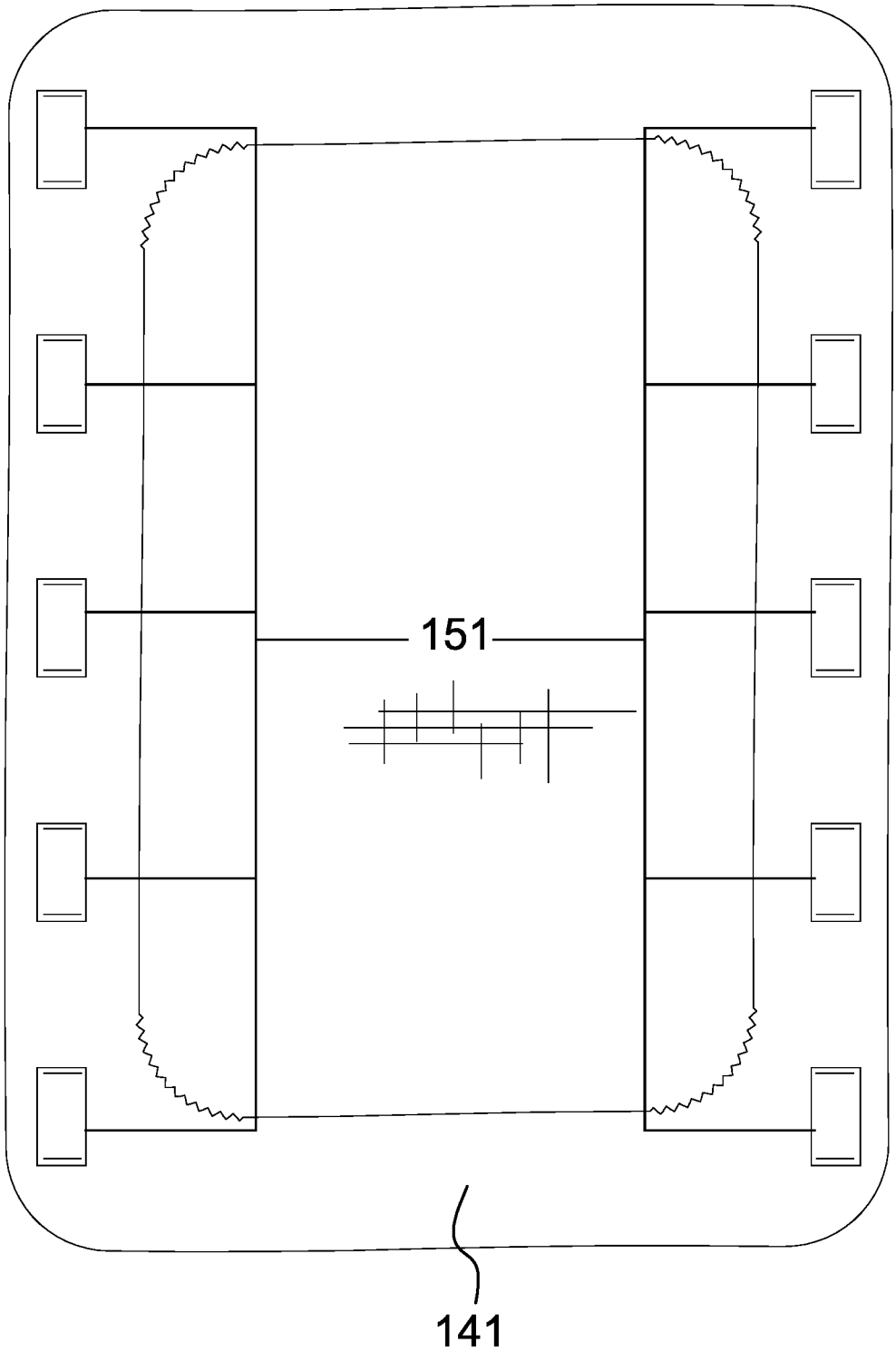
FIG. 4 is an inferior view of an embodiment of the disclosure.
Figure 5:
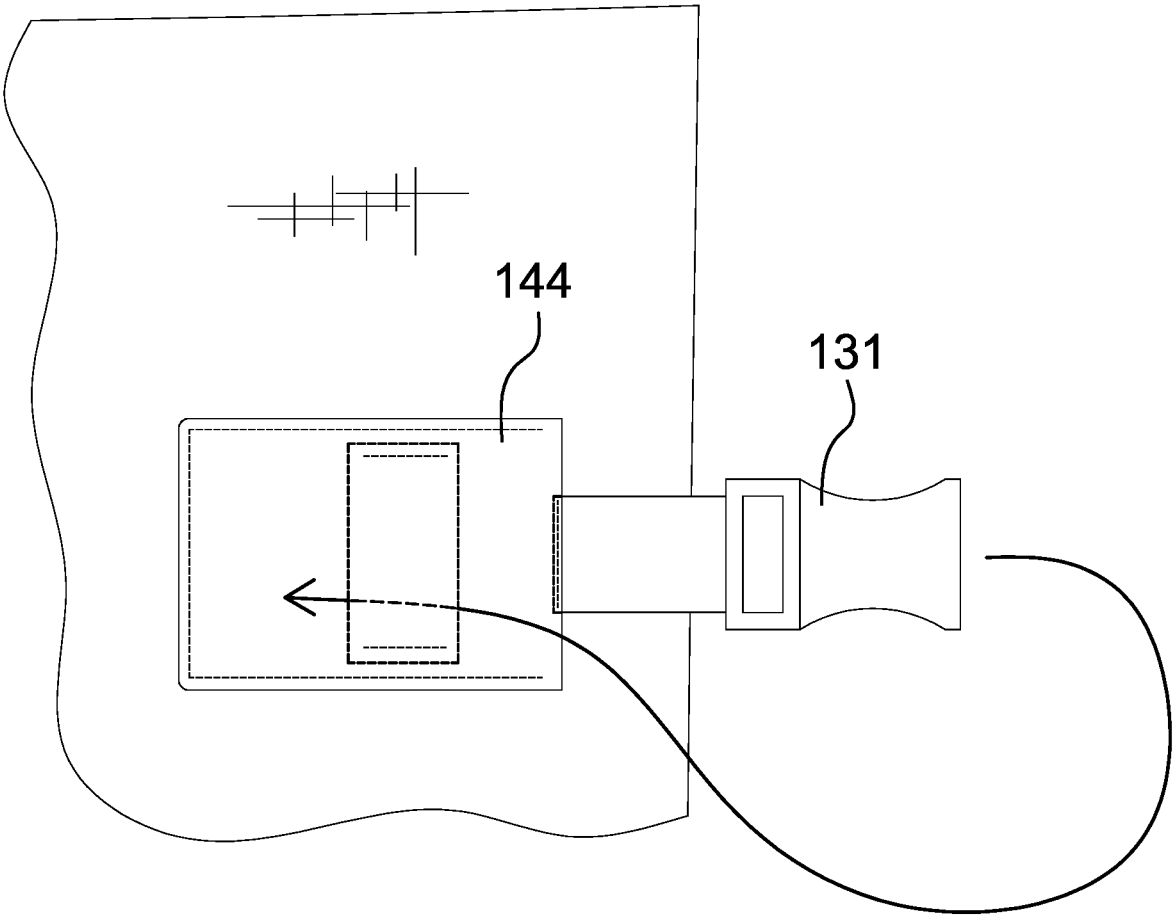
FIG. 5 is a detail view of an embodiment of the disclosure.
Figure 6:
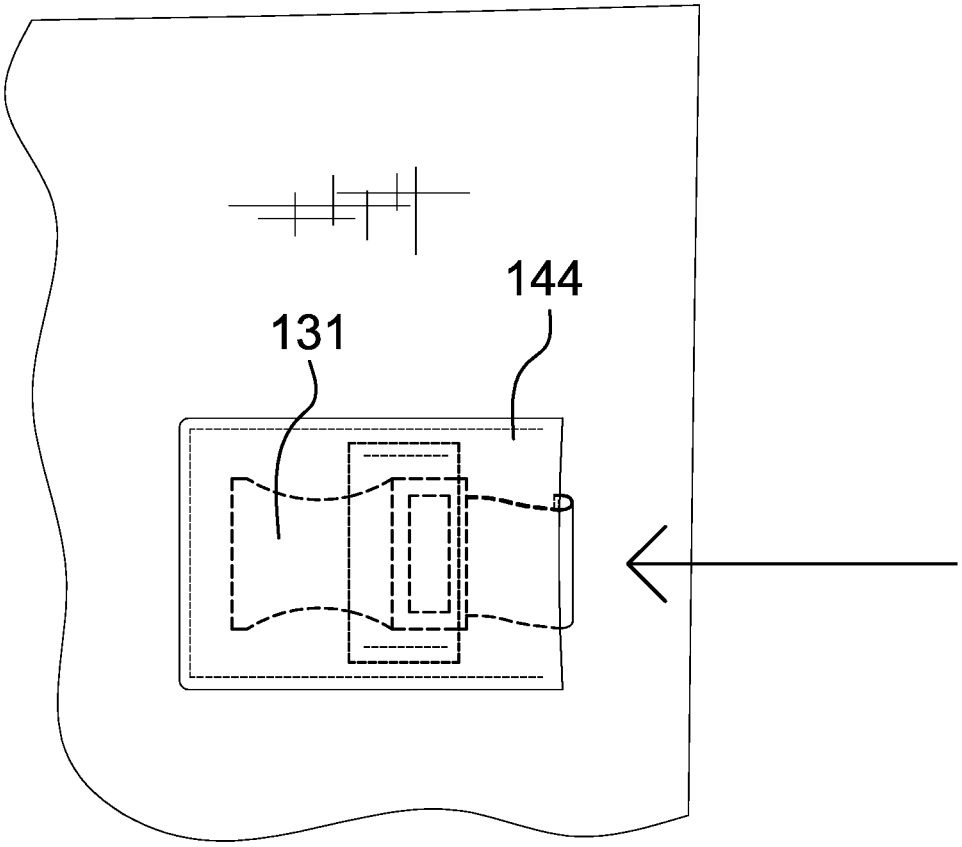
FIG. 6 is a detail view of an embodiment of the disclosure.
Figure 7:
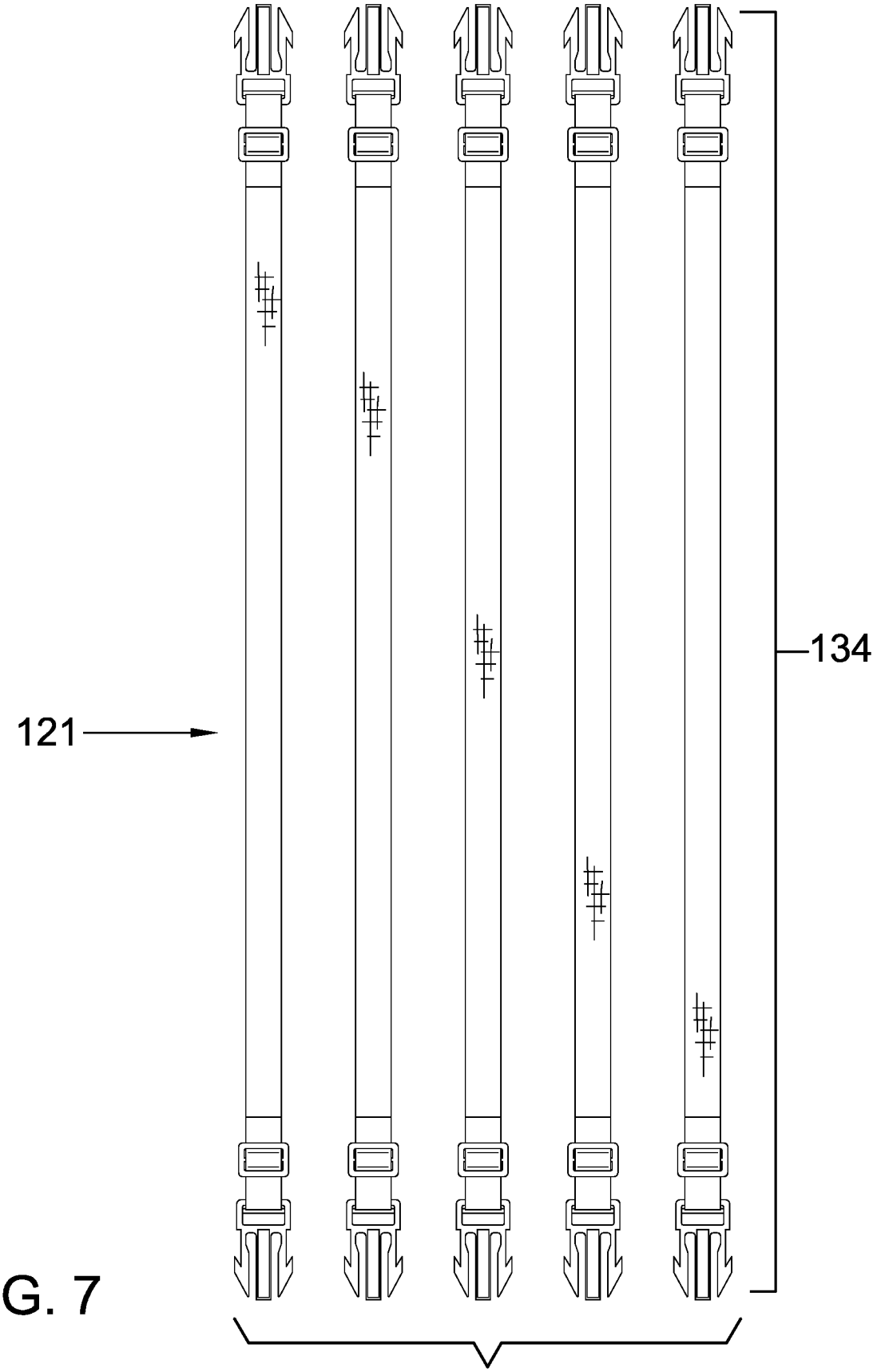
FIG. 7 is a detail view of an embodiment of the disclosure.
Figure 8:
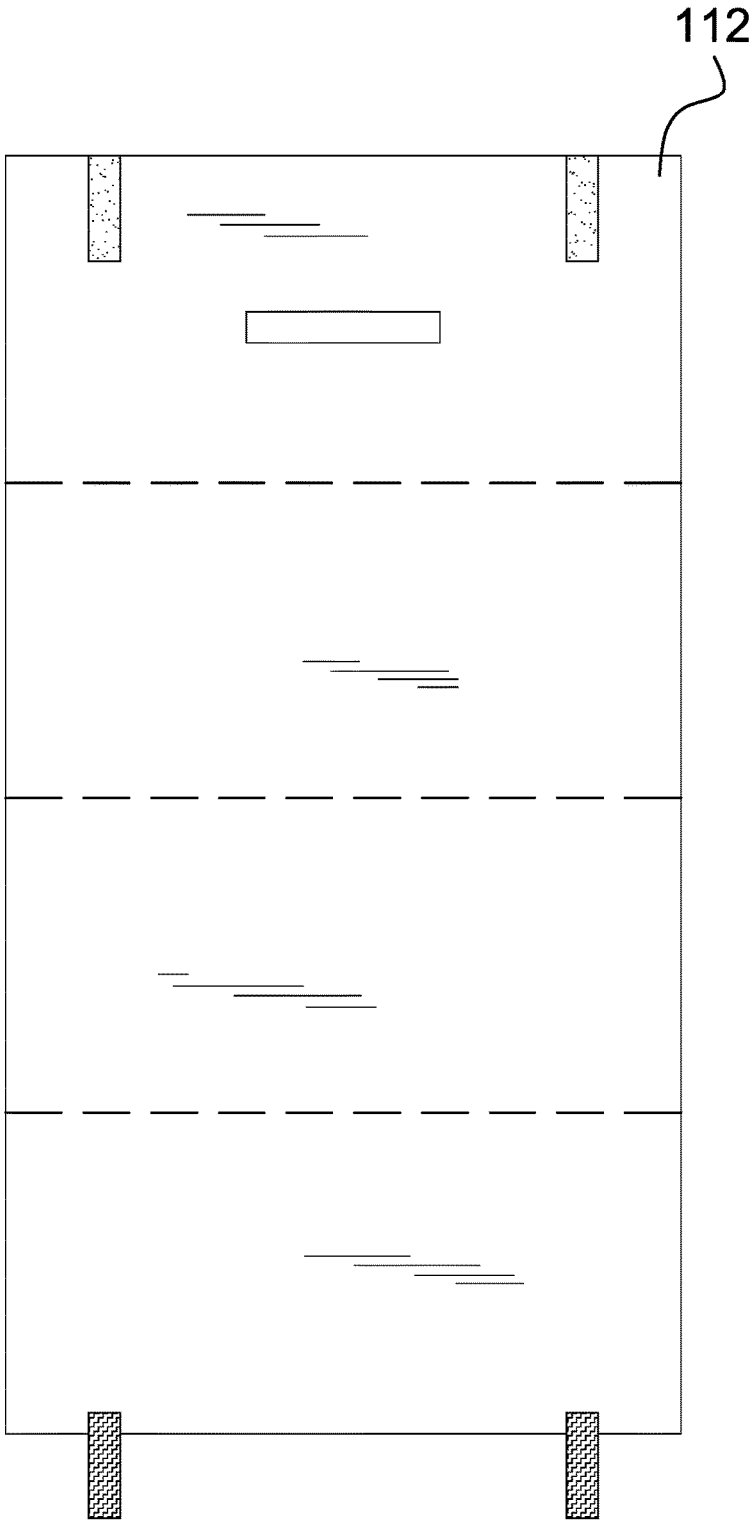
FIG. 8 is a superior view of an embodiment of the disclosure.
Figure 9:
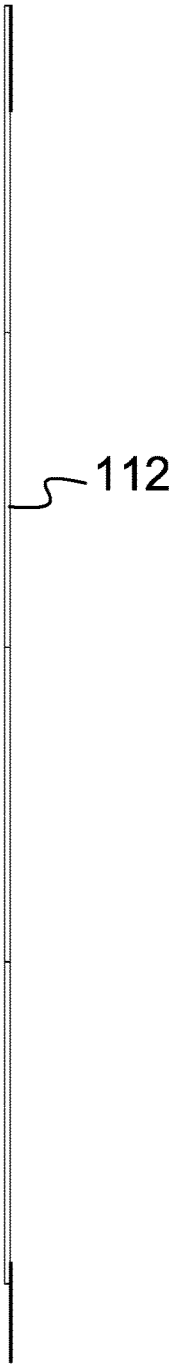
FIG. 9 is side view of an embodiment of the disclosure.
Figure 10:
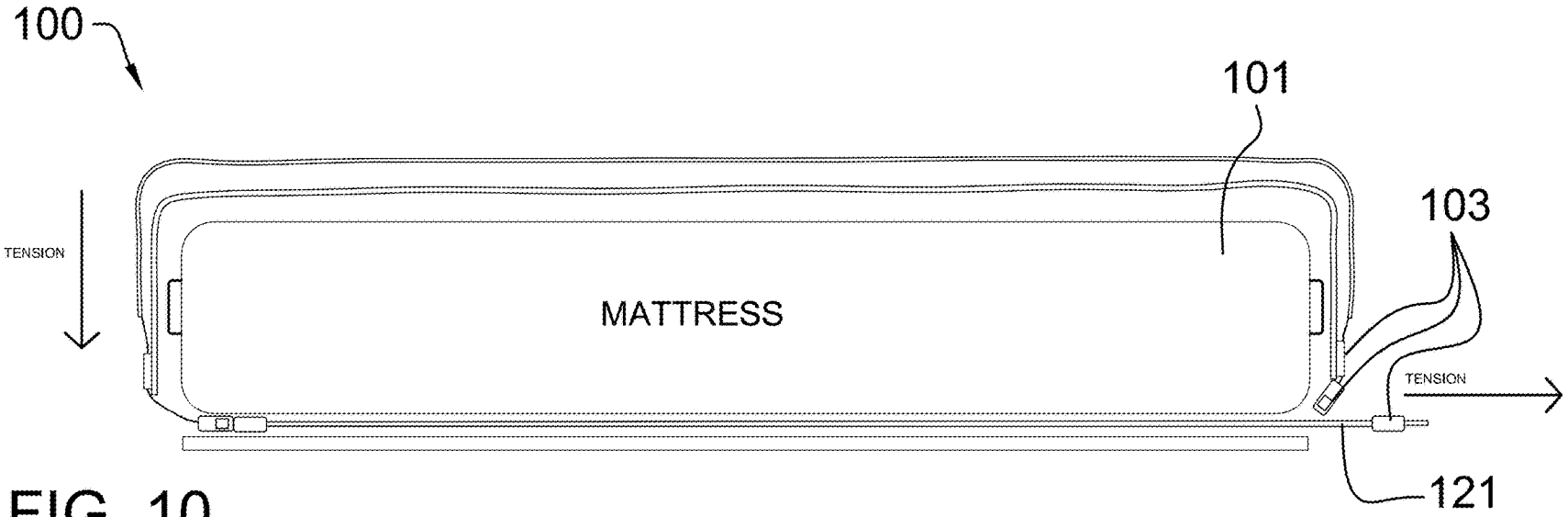
FIG. 10 is an in-use view of an embodiment of the disclosure.
Figure 11:
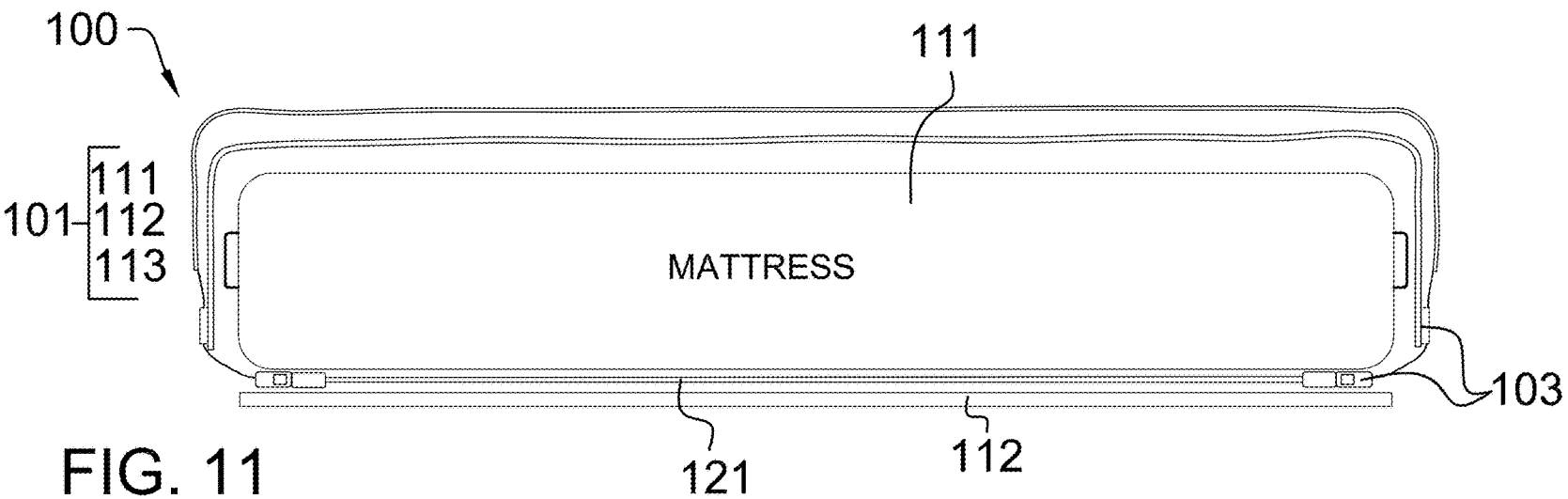
FIG. 11 is an in-use view of an embodiment of the disclosure.

Detailed reference will now be made to one or more potential embodiments of the disclosure, which are illustrated in FIGS. 1 through 11.

The bedding securing and making system 100 (hereinafter invention) comprises a bed structure 101, a plurality of rigid straps 121, and a plurality of fastening devices 103. The plurality of fastening devices 103 attach to the bedding structure. The bed structure 101 further comprises a mattress structure 111, a mattress frame structure 112, and a bedding 113. The mattress structure 111 mounts on the mattress frame structure 112. The plurality of rigid straps 121 and the plurality of fastening devices 103 secure the bedding 113 to the mattress structure 111.

The bed structure 101 is a bed. The bed structure 101 forms a horizontally oriented surface used for sleep. The bed structure 101 comprises a mattress structure 111, a mattress frame structure 112, and a bedding 113.

The mattress structure 111 is a mattress. The mattress structure 111 mounts on the mattress frame structure 112. The mattress structure 111 forms a horizontally oriented cushioned surface used for sleeping.

The mattress frame structure 112 is a furniture item. The mattress frame structure 112 forms a structure that elevates the mattress structure 111 above a supporting surface. The mattress frame structure 112 forms a load path that transfers the load of the mattress structure 111 to the supporting surface.

The bedding 113 forms a structure that forms a protective barrier around the exterior surfaces of the mattress structure 111. The bedding 113 forms a protective barrier between the mattress structure 111 and an individual resting on the bed structure 101. The bedding 113 further comprises an inferior sheet structure 141, a superior sheet structure 142, and an insulating structure 143.

The inferior sheet structure 141 is a sheet. The inferior sheet structure 141 forms a protective barrier that encloses the mattress structure 111. The superior sheet structure 142 is a sheet. The superior sheet structure 142 forms the structure that is sandwiched between the inferior sheet structure 141 and the insulating structure 143. The insulating structure 143 forms a thermal structure. The insulating structure 143 forms a thermally protected structure between the insulating structure 143 and the mattress structure 111. The insulating structure 143 is selected from the group consisting of a comforter and a blanket.

The insulating structure 143 further comprises a plurality of pocket structures 144. Each pocket structure selected from the plurality of pocket structures 144 is a pocket. Each selected pocket structure forms a storage structure. Each selected pocket structure is associated with a fastening device selected from the plurality of fastening devices 103. Each selected pocket structure stores its associated fastening device when the associated fastening device is not in use.

The plurality of rigid straps 121 comprises a collection of webbing structures. Each rigid strap selected from the plurality of rigid straps 121 is a rigid webbing. Each selected rigid strap secures the insulating structure 143 of the bedding 113 to the mattress structure 111 of the bed structure 101. Each selected rigid strap binds the insulating structure 143 to the mattress structure 111. Each selected rigid strap is threaded underneath the mattress structure 111 such that the selected rigid strap is positioned between the mattress structure 111 and the mattress frame structure 112. The free ends of each selected rigid strap are then secured to the insulating structure 143 using the plurality of fastening devices 103.

In the first potential embodiment of the disclosure, the inferior sheet structure 141 further comprises a plurality of rigid strap guides 151. There is a one to one relationship between the plurality of rigid strap guides 151 and the plurality of rigid straps 121. Each rigid strap guide selected from the plurality of rigid strap guides 151 is associated with a rigid strap selected from the plurality of rigid straps 121. Each rigid strap guide selected from the plurality of rigid strap guides 151 is a belt loop that receives its associated rigid strap. The rigid strap guide holds its associated rigid strap in a roughly fixed position relative to the inferior sheet structure 141.

The plurality of fastening devices 103 comprises a collection of fastening devices. The plurality of fastening devices 103 form the mechanical structures that: a) secure the bedding 113 to the mattress structure 111. The plurality of fastening devices 103 comprises a plurality of insulating structure 143 fasteners 131, a plurality of superior sheet structure 142 fasteners 133, and a plurality of plurality of rigid strap 121 fasteners 134.

Each fastener structure selected from the plurality of insulating structure 143 fasteners 131 is the female component of a quick release buckle. Each selected fastener structure is associated with a pocket structure selected from the plurality of pocket structures 144. Each selected fastener structure permanently attaches to its associated selected pocket structure. Each selected fastener structure is contained within its associated selected pocket structure when the selected fastener structure is not secured to a rigid strap fastener selected from the plurality of plurality of rigid strap 121 fasteners 134.

Each superior sheet fastener selected from the plurality of superior sheet structure 142 fasteners 133 is a webbing. Each selected superior sheet fastener attaches to the superior sheet structure 142 such that the selected superior sheet fastener forms a loop on the surface of the superior sheet structure 142. Each selected superior sheet fastener attaches to the superior sheet structure 142 such that any rigid strap selected from the plurality of rigid straps 121 threads through the loop formed by the selected superior sheet fastener. Each selected rigid strap threads through its associated selected superior sheet fastener such that the selected rigid strap is sandwiched between the selected superior sheet fastener and the superior sheet structure 142. The plurality of superior sheet structure 142 fasteners 133 secure the plurality of rigid straps 121 to the superior sheet structure 142.

Each rigid strap fastener selected from the plurality of plurality of rigid strap 121 fasteners 134 is the male component of a quick release buckle. Each selected rigid strap fastener is associated with a rigid strap selected from the plurality of rigid straps 121. Each selected rigid strap fastener attaches to a free end of its associated selected rigid strap. Each selected rigid strap fastener is further associated with a fastener structure selected from the plurality of insulating structure 143 fasteners 131. Each selected rigid strap fastener is sized to match its associated selected fastener structure. Each selected rigid strap fastener inserts into its associated selected fastener structure to secure its associated selected rigid strap to the insulating structure 143. Each selected rigid strap fastener is formed with a quick release buckle. The quick release buckle adjusts the span of the length of the selected rigid strap associated with the selected rigid strap fastener.

The following definitions were used in this disclosure:

Adjustable: As used in this disclosure, the term adjustable refers to the ability of a structure or device to change its fit (or form factor), appearance, input requirements, or its output to meet the needs of a situation.

Bed: As used in this disclosure, a bed refers to a structure, typically a furniture item, used for sleeping or resting. When the structure is a furniture item, the bed comprises a frame and a mattress. The frame is a pedestal that elevates the mattress. A bed often further comprises one or more box frames. The one or more box frames are mechanical structures that form secondary pedestals that elevate the mattress above the frame. A bed often further comprises a headboard. The headboard is a decorative element that forms a protective barrier between the bed and a wall the bed is placed next to. Use Pedestal, elevation, mattress, supporting surface.

Bedding: As used in this disclosure, bedding refers to textile items use to cover or enclose the mattress or frame of a bed. Common bedding items include sheets, blankets, and pillow cases.

Belt Loop: As used in this disclosure, a belt loop is a sheeting structure that is attached to a surface. The sheeting structure is attached to the surface such that an object may be inserted between the surface and the sheeting structure.

Blanket: As used in this disclosure, a blanket refers to an insulating structure that is formed as a sheeting material. A textile based sheeting is often used to form a blanket. A blanket can be coupled with an externally powered structure that allows the blanket to control or change the temperature of the object that the blanket is insulating.

Boundary Structure: As used in this disclosure, a boundary structure is a barrier that separates a first object from a second object such that the second object cannot damage the first object.

Buckle: As used in this disclosure, a buckle is a fastening device that is used for joining a first free end of a strap to a second free end of the same strap or a different strap. A buckle further comprises a first (also called the male) connector that is attached to the first free end and a second (also called the female) connector that is attached to the second free end. The male connector has a pin or other structure that is generally caught by a structure formed in the female connector.

Correspond: As used in this disclosure, the term correspond is used as a comparison between two or more objects wherein one or more properties shared by the two or more objects match, agree, or align within acceptable manufacturing tolerances.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Elastic Nature: As used in this disclosure, an elastic nature refers to a flexible structure that returns to its relaxed shape after the flexible structure has been deformed.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Fastener: As used in this disclosure, a fastener is a device that is used to join or affix two objects. Fasteners generally comprise a first element which is attached to the first object and a second element which is attached to the second object such that the first element and the second element join to removably attach the first object and the second object. Common fasteners include, but are not limited to, hooks, zippers, magnets, snaps, buttons, buckles, quick release buckles, or hook and loop fasteners. A fastener is often referred to as a fastening device.

Fastening Device: As used in this disclosure, a fastening device is a device that is used to join or affix a first object to a second object.

Flexible: As used in this disclosure, flexible refers to an object or material that will deform when a force is applied to it but that will not necessarily return to its original shape when the deforming force is removed.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inelastic Nature: As used in this disclosure, an inelastic nature refers to a flexible structure that maintains its new shape after the flexible structure has been deformed.

Inferior: As used in this disclosure, the term inferior refers to a directional reference that is parallel to and in the same direction as the force of gravity when an object is positioned or used normally.

Insulating Material: As used in this disclosure, an insulating material is a material that inhibits, and ideally prevents, the transfer of heat through the insulating material. Insulating materials may also be used to inhibit or prevent the transfer of sound or the conduction of electricity through the insulating material. Methods to form insulating materials include, but are not limited to: a) the use of materials with low thermal conductivity; b) the use of materials with low electrical conductivity (or high resistivity); and, c) the use of a structural design that places a vacuum within the insulating material within the anticipated transfer path of the heat, sound, or electric current flow.

Insulating Structure: As used in this disclosure, an insulating structure is a structure that inhibits, and ideally prevents, the transfer of heat through the insulating structure. Insulating structures may also be used to inhibit or prevent the transfer of sound through the insulating structure. Methods to form insulating structures include, but are not limited to: 1) the use of materials with low thermal conductivity; and, 2) the use of a structural design that places a vacuum within the insulating structure within the anticipated transfer path of the heat or sound.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first structure including, that is folded or curved to form a closed or nearly closed space such that a linear structure such as a line, a cord or a hook can be inserted through the space formed within the first structure. Within this disclosure, the first structure is said to be looped around the linear structure.

Mattress: As used in this disclosure, a mattress is a disk-shaped structure that forms a cushion used by a patient when lying flat. The superior congruent end of the disk structure of the mattress forms a horizontally oriented surface.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction. In a one to one correspondence, the first element of the first set is said to be associated to the second element of the second set to which the first element corresponds.

Orientation: As used in this disclosure, orientation refers to the positioning of a first object relative to: 1) a second object; or, 2) a fixed position, location, or direction.

Pocket: As used in this disclosure, a pocket is a small pouch or storage space that is formed on or into an object. Pockets are often formed by joining a second textile or a second sheeting to a first textile or a first sheeting.

Protective Barrier: As used in this disclosure, a protected barrier is a boundary structure. The boundary structure forms a barrier that separates a first object from a second object such that the second object cannot damage the first object.

Protection Space: As used in this disclosure, a protection space is a space formed by a boundary structure. The boundary structure forms a protective barrier that protects objects outside the protection space from potential dangers from the operation of a device or process contained within the protection space.

Quick Release Buckle: As used in this disclosure, a quick release buckle is a specific type of buckle wherein the buckle can be readily and easily disconnected by pressing a button or pinching one of the ends of the quick release buckle.

Relaxed Shape: As used in this disclosure, a structure is considered to be in its relaxed state when no shear, strain, or torsional forces are being applied to the structure.

Roughly: As used in this disclosure, roughly refers to a comparison between two objects. Roughly means that the difference between one or more parameters of the two compared objects are not significantly different.

Sandwich: As used in this disclosure, to sandwich means to insert a disk-shaped structure between the exterior surface of a first structure and the exterior surface of a second structure to form a composite structure. Specifically: a) a first congruent end of the disk-shaped structure is placed against the exterior surface of the first structure; and, b) a second congruent end of the disk-shaped structure is placed against the exterior surface of the second structure. The verb to sandwich describes the act of placing the disk-shaped structure between the first structure and the second structure.

Sheet: As used in this disclosure, a sheet is a textile based sheeting used to cover the mattress of a bed. A fitted sheet is a sheet that is further formed with seams and an optional elastic webbing such that the sheet is secured to the mattress without folding.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Textile: As used in this disclosure, a textile is a material that is woven, knitted, braided or felted. Synonyms in common usage for this definition include fabric and cloth. The two surfaces of the textile with the greatest surface area are called the faces of the textile.

Thread: As used in this disclosure, to thread is a verb that refers to inserting a cord or a webbing through one or more holes.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The shape of a webbing is approximated by a rectangular disk shape. The two surfaces of a webbing with the greatest surface area are called the faces of the webbing.

With respect to the above description, it is to be realized that the optimum dimensional relationship for the various components of the invention described above and in FIGS. 1 through 11 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A bedding securing and making system comprising a bed structure, a plurality of rigid straps, and a plurality of fastening devices;

wherein a plurality of webbing structures and the plurality of fastening devices attach to the bedding structure;

wherein the bed structure further comprises a mattress structure, a mattress frame structure, and a bedding;

wherein the plurality of rigid straps and the plurality of fastening devices secure the bedding to the mattress structure;

wherein an insulating structure further comprises a plurality of pocket structures;

wherein each pocket structure selected from the plurality of pocket structures is a pocket;

wherein each selected pocket structure forms a storage structure;

wherein each selected pocket structure is associated with a fastening device selected from the plurality of fastening devices;

wherein the bed structure forms a horizontally oriented surface;

wherein the mattress structure mounts on the mattress frame structure;

wherein the bedding encloses the mattress structure;

wherein the mattress structure mounts on the mattress frame structure;

wherein the mattress structure forms a horizontally oriented cushioned surface;

wherein the mattress frame structure is a furniture item;

wherein the mattress frame structure forms a structure that elevates the mattress structure above a supporting surface;

wherein the mattress frame structure forms a load path that transfers the load of the mattress structure to the supporting surface;

wherein the bedding forms a structure that forms a protective barrier around the exterior surfaces of the mattress structure;

wherein the bedding forms a protective barrier between the mattress structure and an individual resting on the bed structure;

wherein the bedding further comprises an inferior sheet structure, a superior sheet structure, and the insulating structure;

wherein the inferior sheet structure forms a protective barrier that encloses the mattress structure;

wherein the superior sheet structure forms the structure that is sandwiched between the inferior sheet structure and the insulating structure;

wherein the insulating structure forms a thermal structure;

wherein the insulating structure forms a thermally protected structure between the insulating structure and the mattress structure;

wherein the plurality of rigid straps comprises a collection of webbing structures;

wherein each rigid strap selected from the plurality of rigid straps is a rigid webbing;

wherein each selected rigid strap secures the insulating structure of the bedding to the mattress structure of the bed structure;

wherein each selected rigid strap binds the insulating structure to the mattress structure;

wherein each selected rigid strap is threaded underneath the mattress structure such that the selected rigid strap is positioned between the mattress structure and the mattress frame structure;

wherein the free ends of each selected rigid strap are configured to be secured to the insulating structure using the plurality of fastening devices.

2. The bedding securing and making system according to claim 1

Wherein the plurality of fastening devices comprises a collection of fastening devices;

wherein the plurality of fastening devices form the mechanical structures that: a) secure the bedding to the mattress structure.

3. The bedding securing and making system according to claim 2 wherein the plurality of fastening devices comprises a plurality of insulating structure fasteners, a plurality of superior sheet structure fasteners, and a plurality of plurality of rigid strap fasteners;

wherein each fastener structure selected from the plurality of insulating structure fasteners is the female component of a quick release buckle;

wherein each superior sheet fastener selected from the plurality of superior sheet structure fasteners is a webbing;

wherein each rigid strap fastener selected from the plurality of plurality of rigid strap fasteners is the male component of a quick release buckle.

4. The bedding securing and making system according to claim 3 wherein each selected fastener structure is associated with a pocket structure selected from the plurality of pocket structures;

wherein each selected fastener structure permanently attaches to its associated selected pocket structure;

wherein each selected fastener structure is configured to be contained within its associated selected pocket structure when the selected fastener structure is not secured to a rigid strap fastener selected from the plurality of plurality of rigid strap fasteners.

5. The bedding securing and making system according to claim 4 wherein each superior sheet fastener selected from the plurality of superior sheet structure fasteners is a webbing;

wherein each selected superior sheet fastener attaches to the superior sheet structure such that the selected superior sheet fastener forms a loop on the surface of the superior sheet structure;

wherein each selected superior sheet fastener attaches to the superior sheet structure such that any rigid strap selected from the plurality of rigid straps is configured to thread through the loop formed by the selected superior sheet fastener;

wherein each selected rigid strap threads through its associated selected superior sheet fastener such that the selected rigid strap is sandwiched between the selected superior sheet fastener and the superior sheet structure;

wherein the plurality of superior sheet structure fasteners secure the plurality of rigid straps to the superior sheet structure.

6. The bedding securing and making system according to claim 5 wherein each selected rigid strap fastener is associated with a rigid strap selected from the plurality of rigid straps;

wherein each selected rigid strap fastener attaches to a free end of its associated selected rigid strap;

wherein each selected rigid strap fastener is further associated with a fastener structure selected from the plurality of insulating structure fasteners;

wherein each selected rigid strap fastener is sized to match its associated selected fastener structure;

wherein each selected rigid strap fastener inserts into its associated selected fastener structure to secure its associated selected rigid strap to the insulating structure;

wherein each selected rigid strap fastener is formed with a quick release buckle;

wherein the quick release buckle adjusts the span of the length of the selected rigid strap associated with the selected rigid strap fastener.

7. The bedding securing and making system according to claim 6

Wherein the inferior sheet structure further comprises a plurality of rigid strap guides;

wherein each rigid strap guide selected from the plurality of rigid strap guides is associated with a rigid strap selected from the plurality of rigid straps;

wherein each rigid strap guide selected from the plurality of rigid strap guides is a belt loop that receives its associated rigid strap.

* * * * *